US006191754B1

(12) United States Patent
Nathanson et al.

(10) Patent No.: US 6,191,754 B1
(45) Date of Patent: Feb. 20, 2001

(54) ANTENNA SYSTEM USING TIME DELAYS WITH MERCURY WETTED SWITCHES

(75) Inventors: Harvey C. Nathanson, Pittsburgh; Thomas J. Smith, Jr., Greensburgh; Carl B. Freidhoff, New Freedom, all of PA (US); F. William Hopwood, Severna Park; James E. Degenford, Ellicott City, both of MD (US); J. Douglas Adam, Murrysville, PA (US)

(73) Assignee: Northrop Grumman Corporation, Los Angeles, CA (US)

( * ) Notice: Under 35 U.S.C. 154(b), the term of this patent shall be extended for 0 days.

(21) Appl. No.: 09/271,833

(22) Filed: Mar. 18, 1999

Related U.S. Application Data

(63) Continuation-in-part of application No. 09/135,747, filed on Aug. 18, 1998, now Pat. No. 5,912,606.

(51) Int. Cl.[7] ..... H01Q 3/24

(52) U.S. Cl. ..... 343/876; 343/853; 335/47; 342/374

(58) Field of Search ..... 343/853, 876; 333/138, 141, 156, 258; 335/47; 342/368, 374, 375

(56) References Cited

U.S. PATENT DOCUMENTS 3,855,613 * 12/1974 Napoli et al. ..... 357/22
5,381,150 * 1/1995 Hawkins et al. ..... 242/13
5,912,606 * 6/1999 Nathanson et al. ..... 335/47

* cited by examiner

*Primary Examiner*—Tan Ho

(57) ABSTRACT

An electronically steerable antenna array which includes time delay units connected to individual antenna elements for time delaying a microwave signal to and/or from the antenna elements. Each time delay unit includes small mercury wetted switches for controlling signal flow via a time delay path or a bypass path, through the time delay unit from a signal input to a signal output.

13 Claims, 15 Drawing Sheets

ANTENNA SYSTEM USING TIME DELAYS WITH MERCURY WETTED SWITCHES

CROSS REFERENCE TO RELATED APPLICATIONS

This application is a continuation-in-part of application Ser. No. 09/135,747 filed Aug. 18, 1998, now U.S. Pat. No. 5,912,606.

BACKGROUND OF THE INVENTION

1. Field of the invention

The invention in general relates to antenna systems and more particularly to a wideband antenna system which generates one or more electronically steerable beams.

2. Description of related art

Various electronic systems exist which utilize an antenna, having a certain beam pattern, for the transmission and/or reception of microwave energy. For many of these systems it is a requirement that they function at relatively wideband operation. For example, in the communications art, the amount of information which can be transmitted depends upon the bandwidth of the system, with the greater the bandwidth, the greater the data rate. In the radar field, for example, improved range resolution may be achieved with wideband operation.

Many such electronic systems utilize an electronically steerable array (ESA) antenna system to augment, or eliminate the physical mechanical steering of the antenna structure. Basically, in an ESA arrangement, the antenna is comprised of a plurality of individual antenna elements and means are provided for each antenna element to alter the phase of the microwave signal going to (or coming from) the antenna element in order to steer the antenna beam in a certain off-axis direction, depending upon the phase alterations.

Typical phase altering devices include phase shifters and time delay circuits. In general, due to the requirement for constant time delay for electronic steering of the antenna beam, phase shifters do not perform well for wideband operation.

Time delay circuits can provide the necessary phase alteration across the entire face of the antenna structure to achieve desired off-axis directionality. A typical electronic time delay circuit includes a plurality of delay line stages each with a different delay time insertable into the microwave signal path. The insertion or removal of a delay segment is accomplished by miniature switches the states of which are governed by a control circuit.

For example, miniature electronic microwave switches in common use include the gallium arsenide (GaAs) field effect transistor (FET) and the GaAs pin diode. Both of these devices operate at extremely high speeds and can achieve switching rates measurable in nanoseconds.

For some applications however, the GaAs FET has objectionably high resistance when closed and high capacitance when open, resulting in a relatively low cut-off frequency, for example, 600 GHz. The pin diode exhibits a higher cut-off frequency of around 2 THz, however it, along with the GaAs FET, exhibits an objectionably high capacitance in the off state. For this reason these switches are often operated with a separate shunt inductor resonant with the capacitance, at the operating frequency.

This added inductor advantageously increases the impedance of the switch in the off condition, however this arrangement objectionably lowers the operating bandwidth of the overall switch device. In addition, the pin diode switch requires an expenditure of current to hold it in the on condition, as well as a means to inject and remove this current. This bias coupling current lowers the effective cut off frequency of the pin diode switch. For example this current may be in the order of around 1 to 10 milliamps per diode switch. There may be, however, thousands of such switches in an entire ESA system resulting in an objectionably high power consumption, measurable in kilowatts.

The antenna system of the present invention utilizing delay lines with small switches having significantly lower capacitance in the off state and lower resistance in the on state results in a system with a high cut-off frequency and true time delay across a wide band of frequencies.

SUMMARY OF THE INVENTION

The electronically steerable antenna array system of the present invention includes time delay units connected to respective ones of antenna elements. Each time delay unit has a signal input and signal output with a plurality of microstrip delay line stages connected between them. Each delay line stage, connected by an interstage connector, has a delay line segment path and a bypass segment path selectively chosen by means of predetermined control signals applied to a mercury wetted switch. These switches each include three microstrip conductors, respectively being connectable with the delay line segment, the bypass segment and the interstage connector. Each conductor includes a mercury droplet which forms electrical contact with a mercury droplet of one of the other conductors in response to the control signals.

DESCRIPTION OF THE PREFERRED EMBODIMENT

Figure 1A:
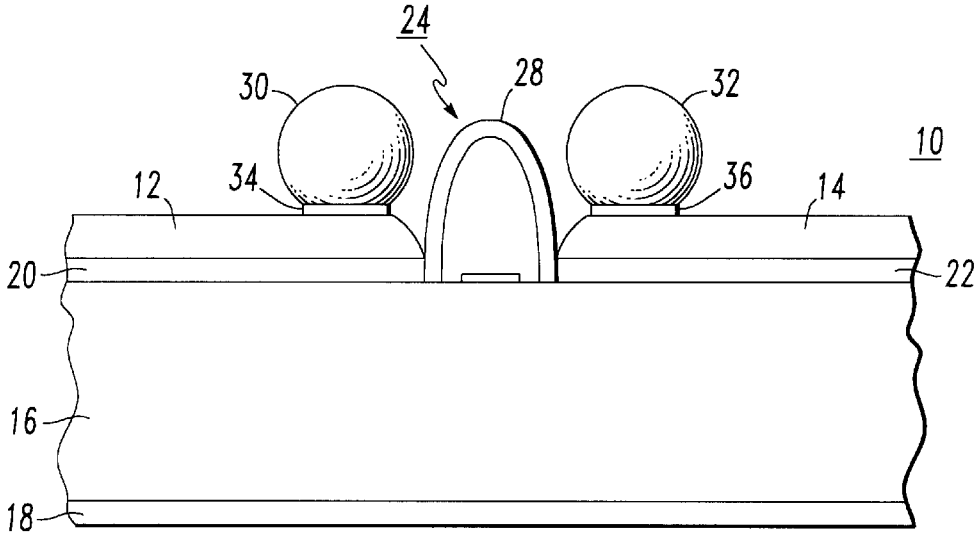
FIGS. 1A and 1B are respective side and perspective views of one embodiment of a switch utilized in the present invention, and shown in the open condition.

In the drawings, which are not necessarily to scale, like or corresponding parts are denoted by like or corresponding reference numerals.

Figure 1B:
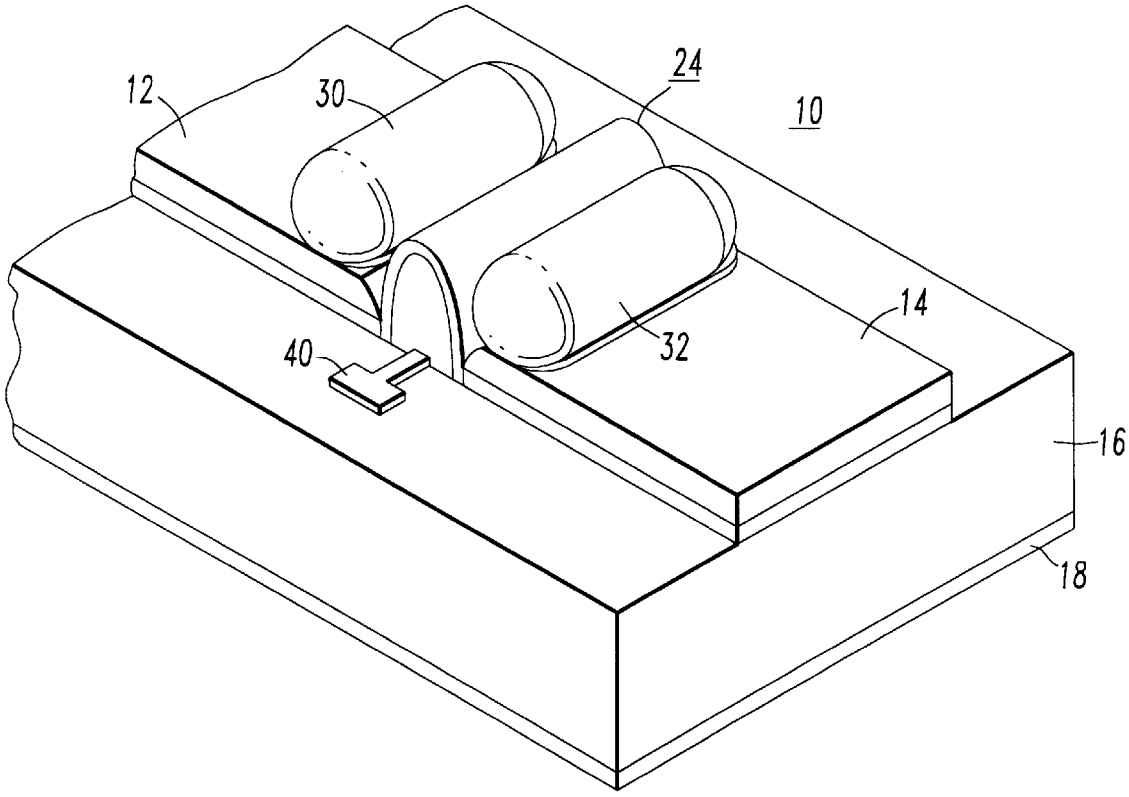

Referring now to FIGS. 1A and 1B, there is illustrated switch 10 having first and second conductors 12 and 14 affixed to a substrate 16, such as alumina. As will be described, the switch, or various embodiments, is part of a time delay circuit used in the electronically steerable antenna array of the present invention. Conductors 12 and 14 represent, by way of example, a 50 ohm characteristic impedance RF microstrip line, with a ground plane 18 positioned on the other side of substrate 16. Chromium or titanium/gold base layers 20 and 22 may be utilized for better adhesion of the conductors 12 and 14 to the substrate 16.

Conductors 12 and 14 are adjacent but separated from one another so that no electrical contact is made between them. A gate member 24 is disposed between the conductors 12 and 14 at the respective ends thereof, and includes a dielectric oxide coating 28 on the surface thereof. The gate member 24 is electrically conductive but has a high resistivity to prevent RF conduction and may be constituted by a polysilicon material. The oxide coating 28 may be silicon dioxide, or any other suitable coating such as silicon nitride, or silicon oxynitride, by way of example.

The switch includes respective first and second mercury droplets 30 and 32 which are elongated and electrically connected to respective conductors 12 and 14 by means of bonding layers, or pads, 34 and 36. These bonding layers 34 and 36 are of a material, such as silver, to cause the mercury droplets to be held in place by wetting action. Other bonding materials include, for example, chromium, vanadium, niobium, molybdenum, tantalum and iridium.

During operation, the RF microstrip conductors 12 and 14 are maintained at ground potential at DC or at the low frequency associated with control voltages applied to the gate member 24. A control electrode 40 electrically connected to gate member 24 is operable to receive a positive or negative DC control signal, relative to the mercury droplets 30 and 32, causing them to experience a lateral field to not only wet the oxide coating 28 but to pull the mercury droplets to the top of the gate member 24 where they may be physically joined, as illustrated in FIGS. 2A and 2B.

Figure 2A:
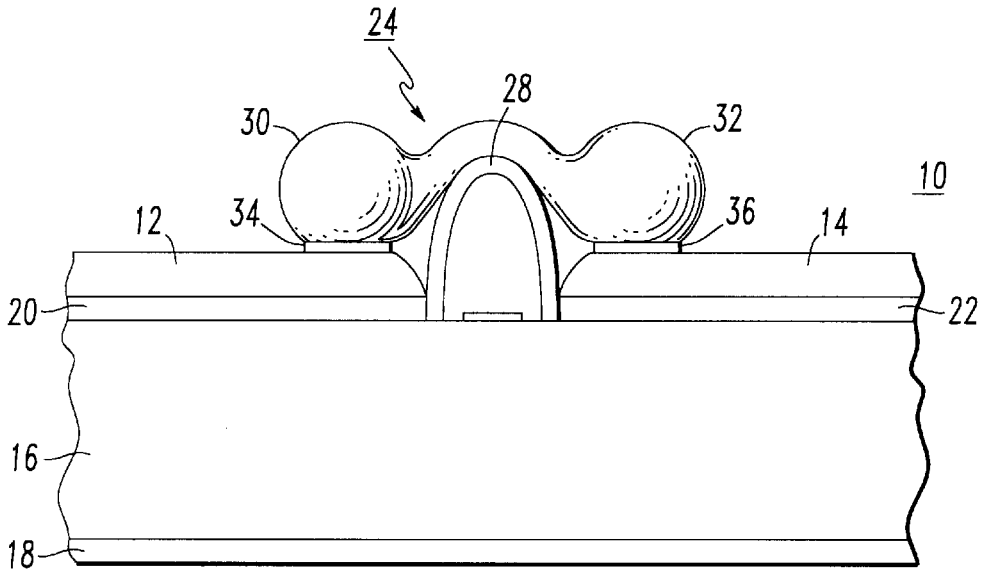
FIGS. 2A and 2B are respective side and perspective views of the switch, shown in the closed condition.
Figure 2B:
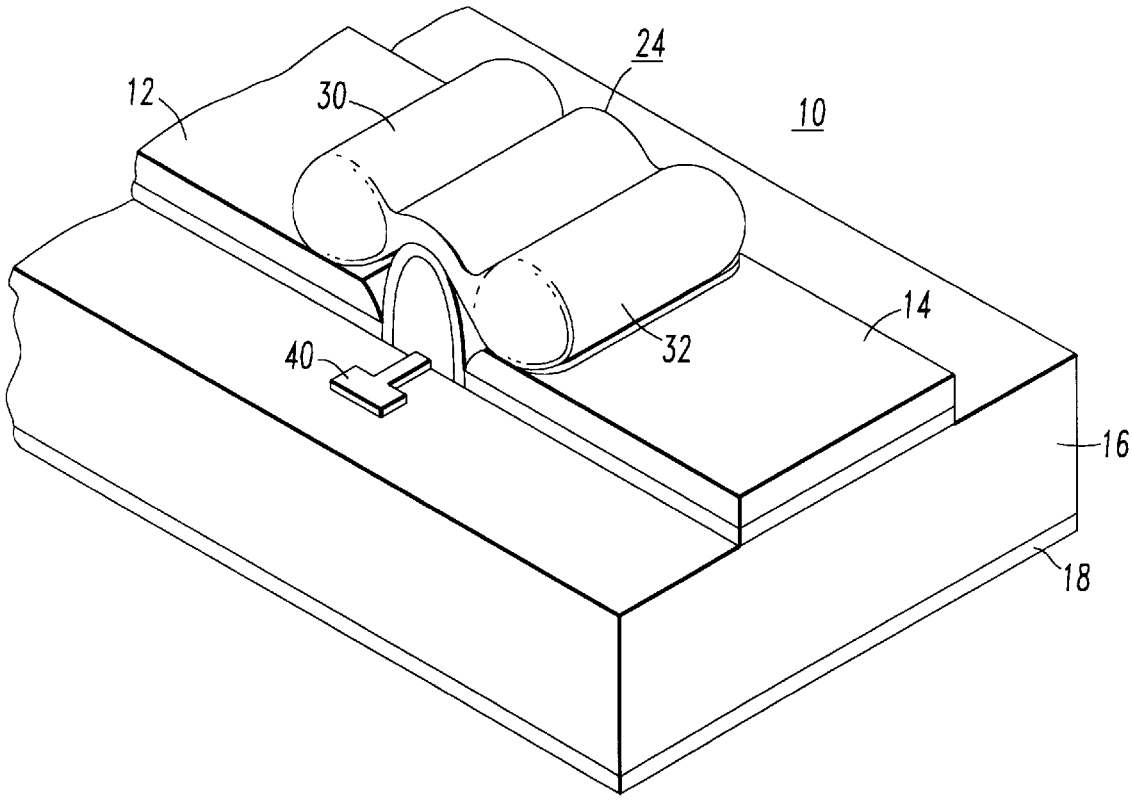

As seen in FIGS. 2A and 2B application of the control signal to electrode 40 causes wetting of the oxide coating 28 to the extent that the mercury droplets are now joined by a mercury bridge 42 and will remained joined as long as the applied control signal is present. Upon removal of the control signal the mercury droplets 30 and 32 will revert to their respective positions illustrated in FIGS. 1A and 1B.

Figure 3A:
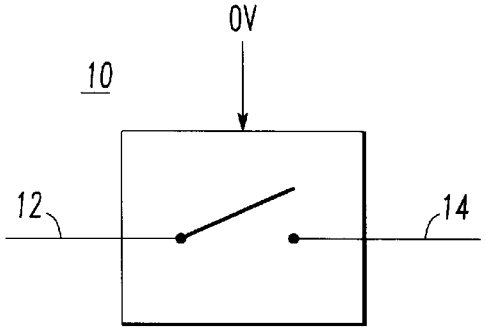
FIGS. 3A and 3B functionally illustrate the switch in its respective open and closed condition.
Figure 3B:
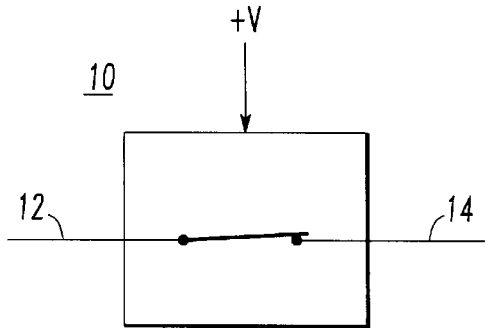

FIGS. 3A and 3B illustrate the functional operation of the switch. In FIG. 3A with no control signal applied, the switch 10 is in an open condition and no RF signal passes between the conductors 12 and 14. With the application of, for example, a positive DC control signal (+V) of a predetermined magnitude, as illustrated in FIG. 3B, the switch assumes a closed condition to allow propagation of the RF signal.

Figure 4A:
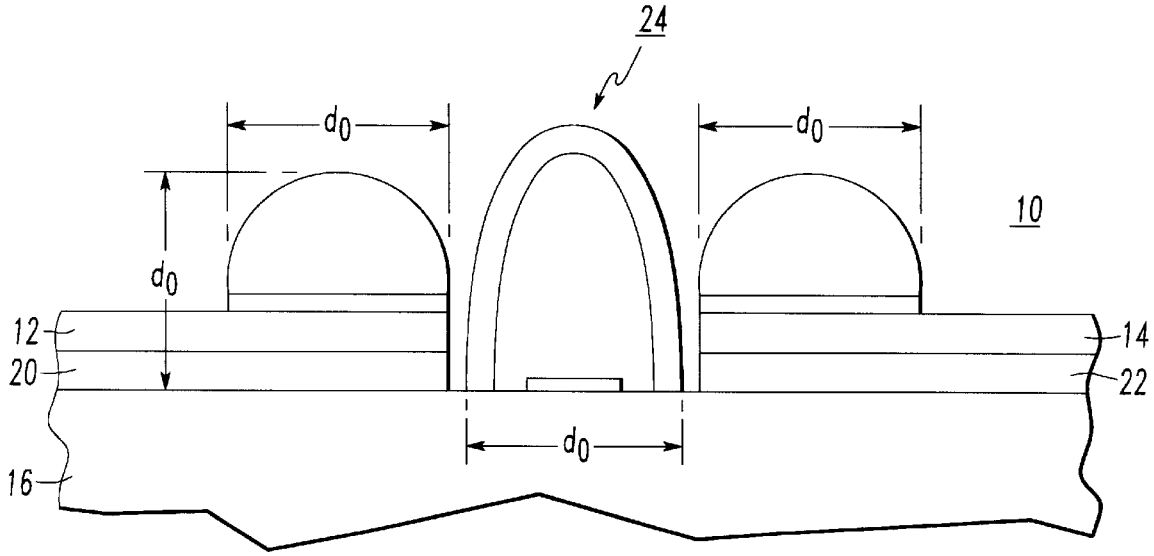
FIG. 4A illustrates some dimensions of the switch and FIG. 4B illustrates the electrical equivalent of the switch.

The predetermined magnitude of the control signal will depend upon the dimensions of the switch elements. By way of example, with reference to FIG. 4A, assume for the purpose of illustration that the microstrip conductors 12 and 14 have a characteristic impedance of 50 ohms with a width of 0.0254 cm (254 $\mu$m). Mercury droplets 30 and 32 each have a length (into the plane of the Fig.) equal to, or slightly less than the width of the microstrip line. Each mercury droplet has a width $d_o$, where $d_o$ is about 20 $\mu$tm, which is approximately equal to its height as measured from the top of the droplet to the substrate 16. The width of the gate member 24, at its base is also assumed equal to $d_o$.

Figure 4B:
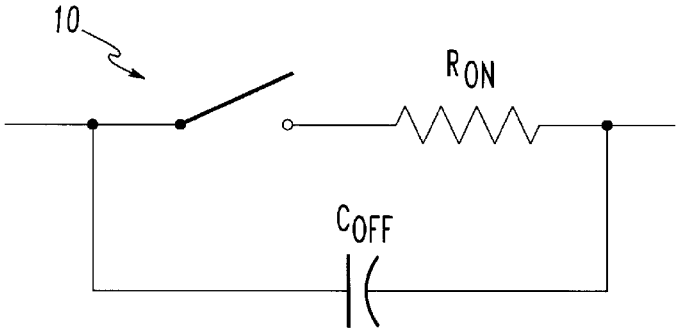

With these values a gate voltage on the order of 50 volts will suffice to close the switch when the oxide coating 28 is on the order of 1000 Å thick. Further, with these dimensions, and as illustrated in FIG. 4B, showing the electrical equivalent of the switch, the switch will have no significant inductance, an extremely low on resistance $R_{ON}$ on the order of 20 milliohms and a low off capacitance $C_{OFF}$ on the order of $2.5\times10^{-14}$ farads. These low values delineate the operating cutoff frequency $F_{CO}$, where:

$$F_{CO}=1/(2\pi\times R_{ON}\times C_{OFF}) \quad \text{eq (1)}$$

Substituting the $R_{ON}$ and $C_{OFF}$ values of 20 milliohms and $2.5\times10^{-14}$ farads into equation (1) yields an extremely high cutoff frequency of around 318 THz.

Figure 5A:
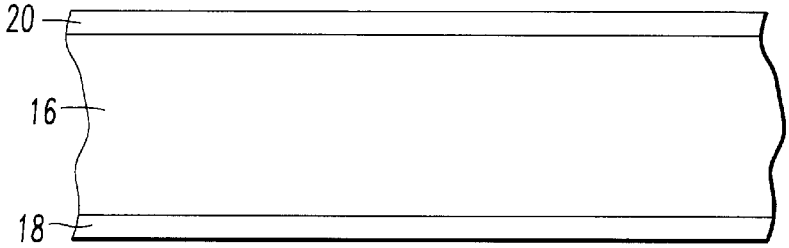
FIGS. 5A–5J illustrate the fabrication of the switch.
Figure 5B:
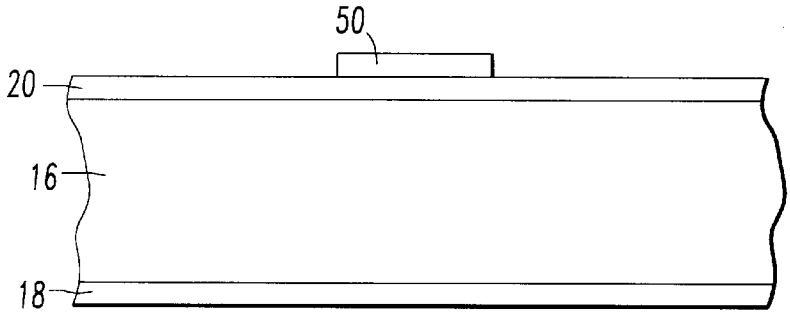
Figure 5C:
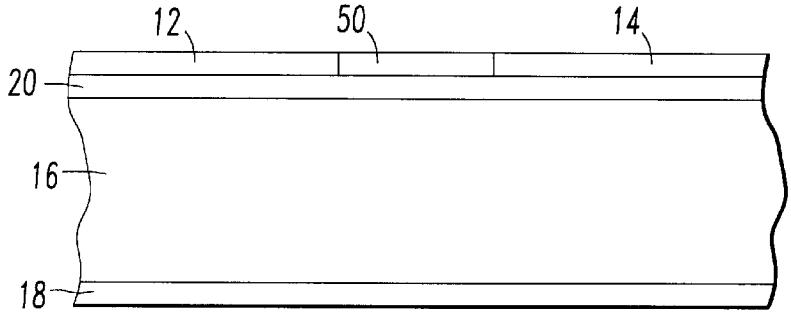

The structure of switch 10 lends itself to batch fabrication. FIGS. 5A through 5J illustrate one such process. In FIG. 5A the titanium and gold layer 20 has been applied to the top of substrate 16, and ground plane 18 been applied to the bottom thereof. A separator 50, as illustrated in FIG. 5B, is deposited, such as by photolithographic methods, after which the separated microstrip conductors 12 and 14 are plated, as in FIG. 5C.

Figure 5D:
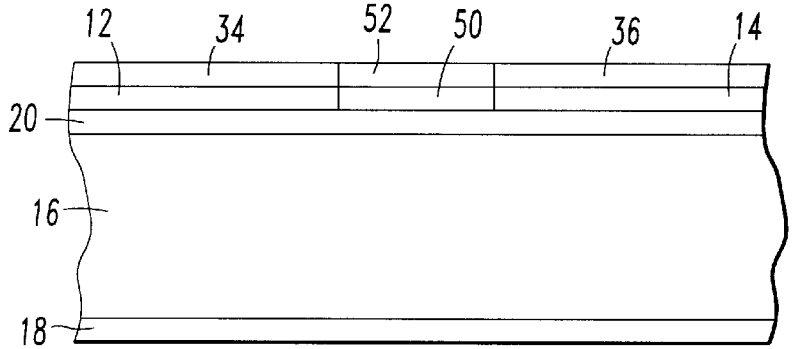
Figure 5E:
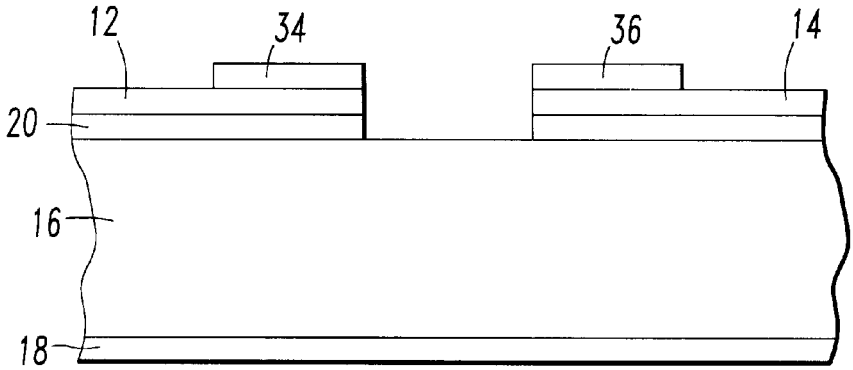

In FIGS. 5D and 5E another separator 52 is formed, and bonding layers 34 and 35 are evaporated on the microstrip conductors after which the bonding layers 34 and 36 are etched to the proper size and the separators are removed, as well as the titanium/gold layer underlying the separators.

Figure 5F:
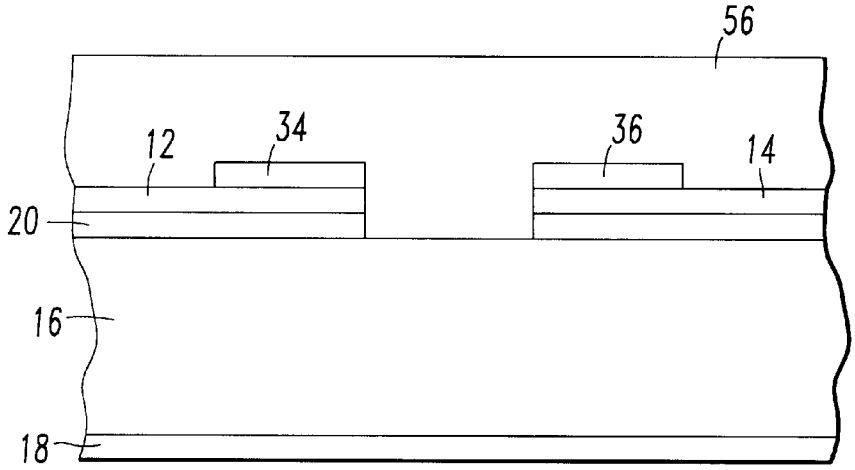
Figure 5G:
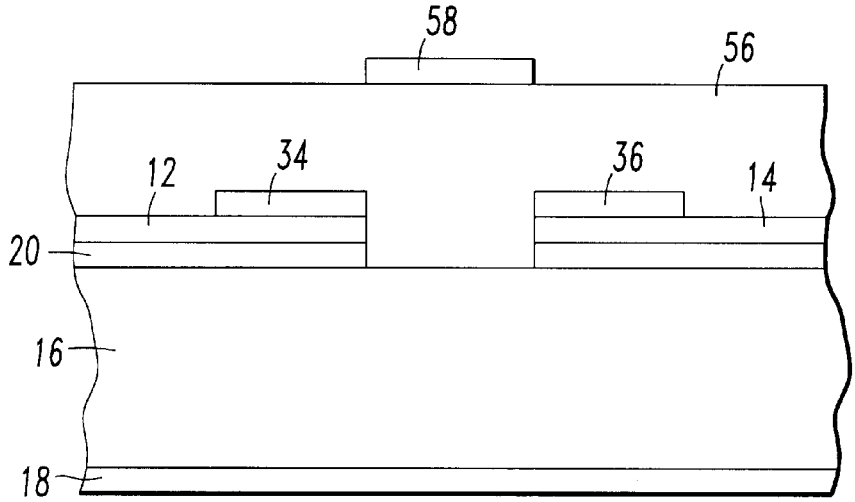
Figure 5H:
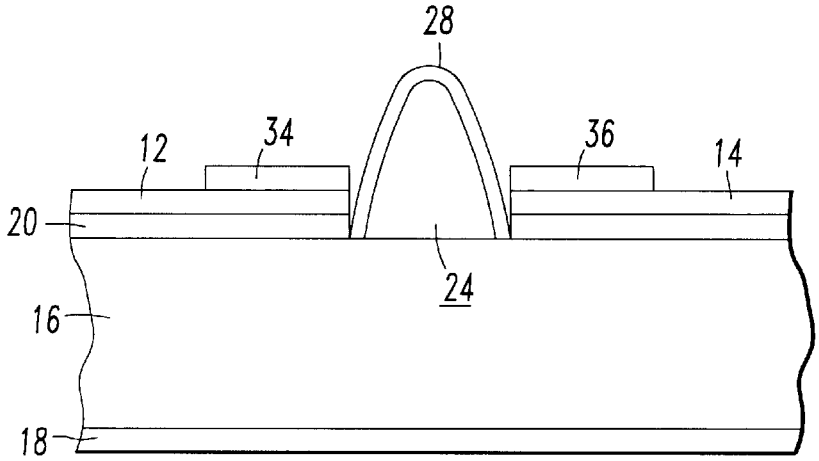

In the next step, as illustrated in FIG. 5F, about 20 $\mu$m of high resistivity polysilicon 56 is sputtered on and a photoresist 58 is applied, as in FIG. 5G. By a vertical reactive-ion dry-etch process the gate member 24 is formed. The photoresist 58 is removed, the gate member etched and thereafter anodized to form the oxide coating 28, all of which is depicted in FIG. 5.

Figure 5I:
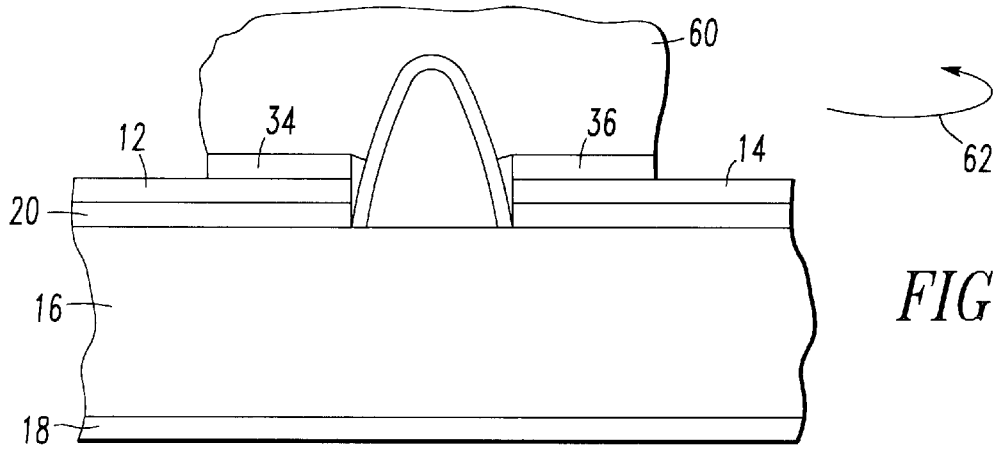
Figure 5J:
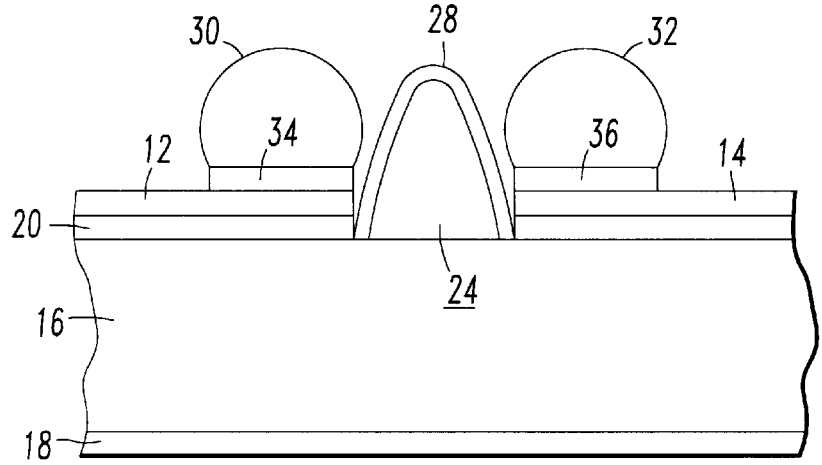

The structure of FIG. 5F is dipped into a mercury bath and removed, leaving a body of mercury 60 clinging to the bonding layers 34 and 36 and over the gate member 24. This is illustrated in FIG. 5I. The structure with the excess mercury is spun, as indicated by arrow 62, at about 300 rpm whereby the excess mercury is removed, leaving the well defined mercury droplets 34 and 36 as in FIG. 5J. If desired, the excess mercury removal may also be accomplished by electric field stripping wherein an electric field between an anode and the body of mercury pulls away the excess mercury until, as the cross section approaches 1:1, the mercury becomes stiff enough to resist further removal by field stripping.

Another mercury deposition method includes vacuum evaporation of mercury onto a substrate using photoresist to aid in selective deposition of the mercury onto the bonding layer. Suitable dielectric materials may serve the role of the photoresist.

Figure 6A:
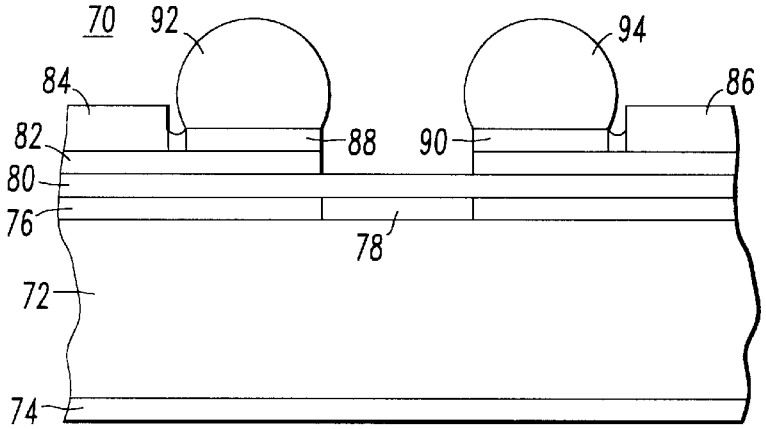
FIGS. 6A and 6B illustrate another embodiment of a switch which may be utilized in the present invention.
Figure 6B:
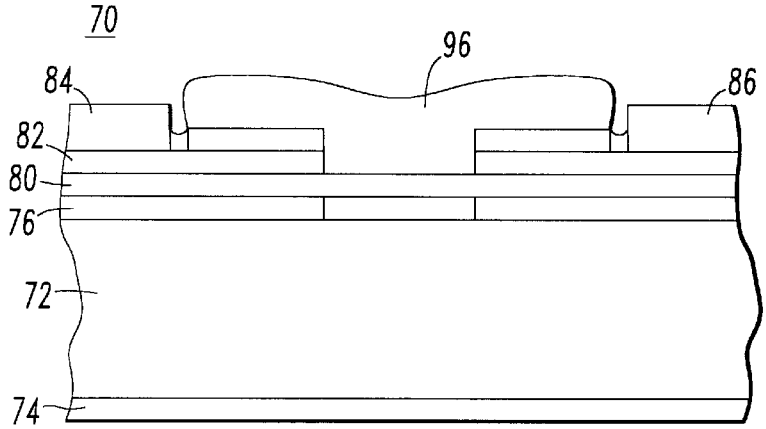

FIGS. 6A and 6B illustrate another embodiment of a mercury wetted switch utilizable in the invention and which is simpler to fabricate and has an even lower value of off capacitance than that previously described, resulting in a higher cut off frequency. Switch 70 includes a substrate 72, having a ground plane 74 on the bottom side thereof and a high sheet resistivity polysilicon layer 76 on the top side. A portion of this layer is given a localized lower resistivity, such as by diffusion, to form a gate member 78.

A dielectric layer 80, such as a oxynitride, covers polysilicon 76, and this dielectric layer receives a titanium/gold base layer 82 to which is applied first and second microstrip conductors 84 and 86. Also applied to the titanium/gold base layer 82 are respective bonding layers, or pads, 88 and 90 for receiving respective mercury droplets 92 and 94.

In the absence of an applied control signal to gate member 78, the mercury droplets 92 and 94 are as illustrated in FIG. 6A such that switch 70 is in an open condition with no RF conduction between conductors 84 and 86. With the application of a suitable control signal to gate member 78, as illustrated in FIG. 6B, the mercury droplets are drawn toward the gate member 78 and contact one another forming a unitary mass of mercury 96 electrically contacting both conductors 84 and 86, thus closing the switch. When the control signal is removed, the mercury withdraws from the dielectric layer 80 and again assumes the configuration shown in FIG. 6A.

Figure 7A:
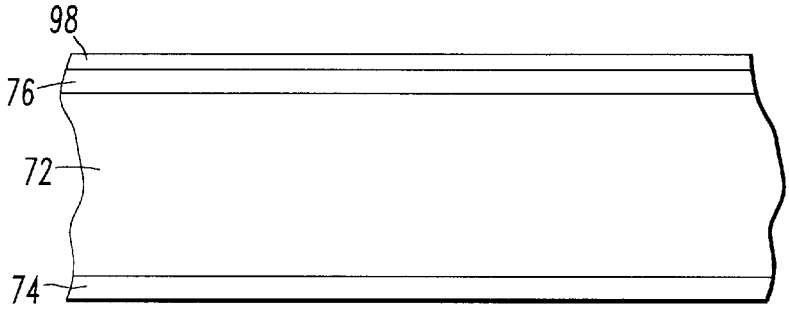
FIGS. 7A–7G illustrate the fabrication of the embodiment of the switch shown in FIGS. 6A and 6B.

One fabrication technique for this second switch embodiment is illustrated in FIGS. 7A through 7G. In FIG. 7A, a substrate member 72, having a ground plane 74, has applied to the exposed surface thereof the polysilicon layer 76. A temporary protective oxide coating 98 is deposited on the polysilicon layer 76 by deposition or by oxidizing the surface of the polysilicon.

Figure 7B:
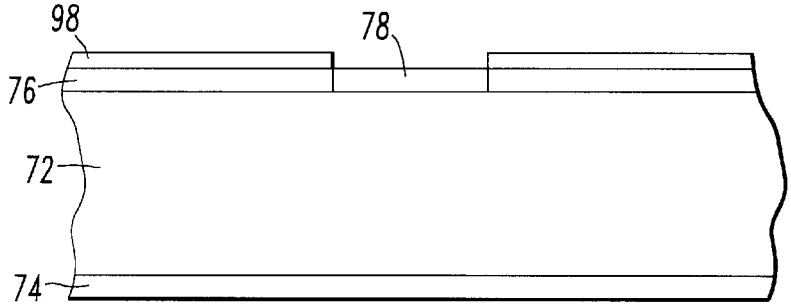

In FIG. 7B the oxide coating 98 has been opened and a diffusion or ion implantation process decreases the resistivity of the polysilicon layer in a limited area, to define the gate member 78.

Figure 7C:
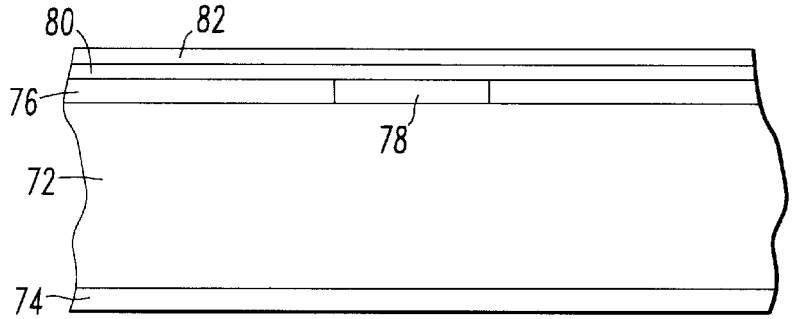
Figure 7D:
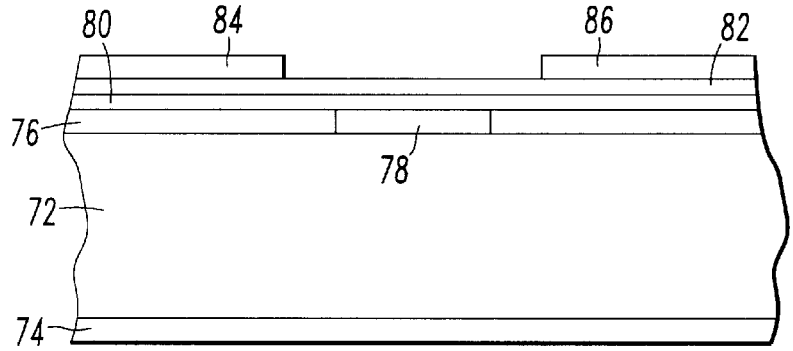

In FIG. 7C, the first oxide coating 98 is removed and the dielectric oxynitride layer 80 is applied, as is titanium/gold layer 82 for receiving the conductors 84 and 86, as illustrated in FIG. 7D. The conductors 84 and 86 may be plated on the titanium/gold layer 82 with the use of a photoresist, which has already been removed in FIG. 7D.

Figure 7E:
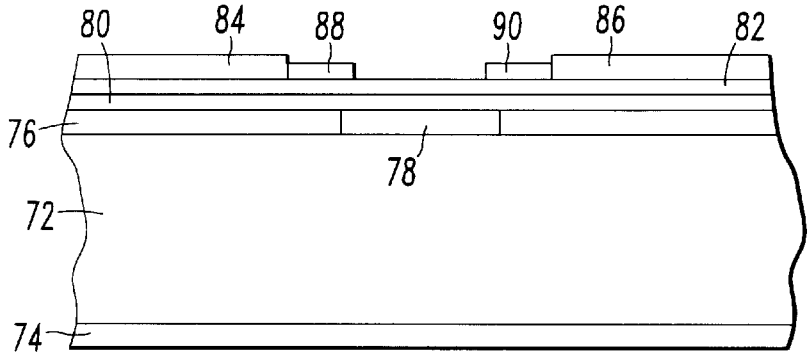
Figure 7F:
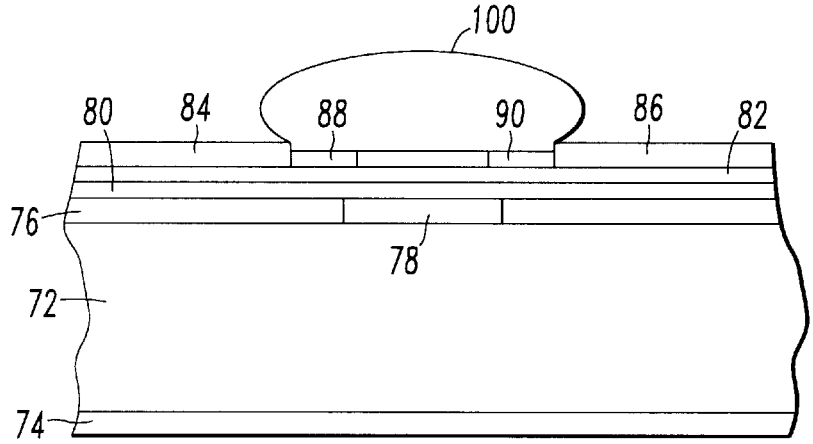
Figure 7G:
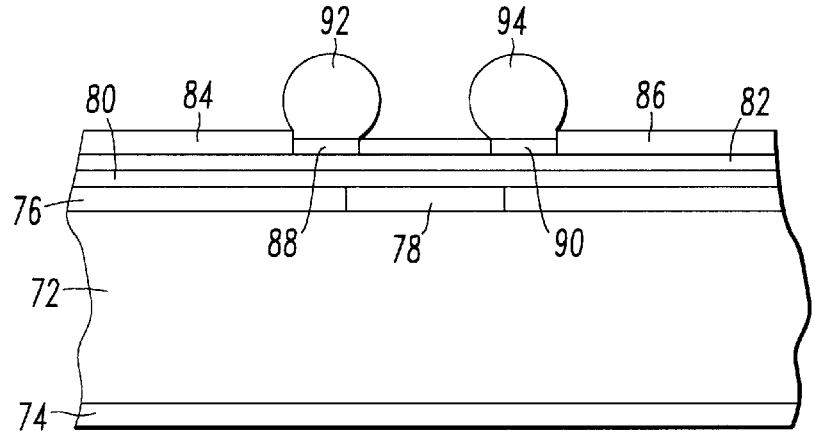

In FIG. 7E, mercury droplet bonding pads 88 and 90 are evaporated onto the titanium/gold layer 82 and the middle section of this layer is removed leaving an exposed portion of dielectric layer 80 between the pads 88 and 90. The structure of FIG. 7E is dipped into a mercury bath and removed, as illustrated in FIG. 7F, leaving a body of mercury 100 clinging to the bonding layers 88 and 90 as well as to the dielectric over the gate member 78. Excess mercury may be removed by one of the aforementioned spin or field stripping processes leaving the switch structure of FIG. 7G. Direct vacuum evaporation of mercury onto the pads may also be accomplished.

Although not illustrated, after fabrication the switch or switches may be placed in a hermetically sealed container filled with an inert gas, such as argon, prior to use. This container can either be external, or an integrally constructed configuration relative to the switch. The mercury wetted switch is utilized in the delay selection paths of time delay circuits of an ESA system, a sample one of which is illustrated in FIG. 8.

Figure 8:
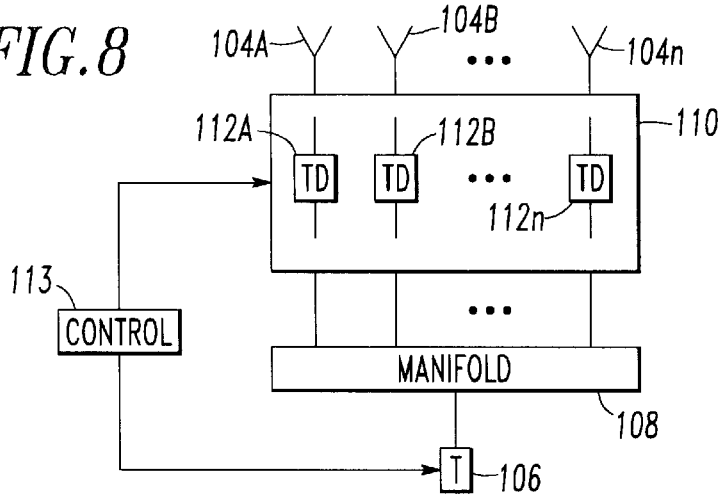
FIG. 8 is a block diagram of an antenna system in accordance with the present invention.

FIG. 8 is a simplified representation of the transmitter function of a radar system having a plurality of antenna elements 104A, 104B . . . 104*n*. A transmitter 106 provides a microwave signal to be transmitted, to a manifold circuit 108 which distributes the signal to the plurality of antenna elements. A transmitter beam, or a plurality of such beams may be formed and steered, with the provision of a delay circuit 110 comprised of a plurality of time delay units 112A, 112B, . . . 112*n*, and all being governed by a control means 113. In a similar manner, receiver beams may be formed and steered utilizing similar delay units.

Figure 8A:
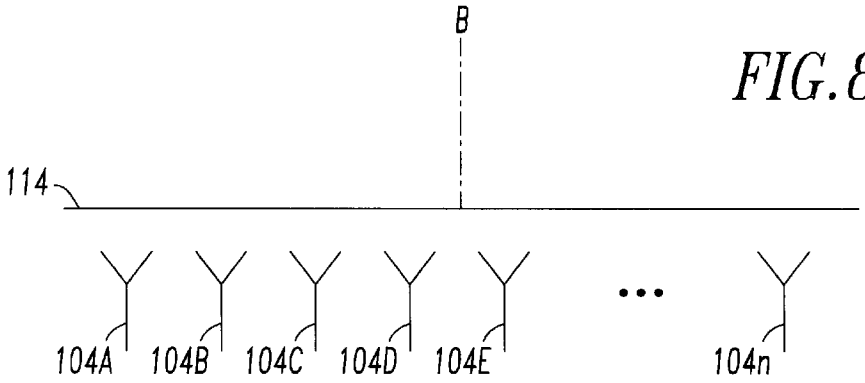
FIGS. 8A and 8B show a plurality of antenna elements to illustrate beam direction.

FIG. 8A illustrates the plurality of antenna elements 104A to 104*n* in relation to a uniphase front 114 of an incoming signal. The antenna elements, which may typically be dipoles, slots, open ended waveguides or printed circuit patches, by way of example, are each connected to a respective time delay unit, as illustrated in FIG. 8. For simplicity, a line array is illustrated, although the principles are equally applicable to a two dimensional array.

In FIG. 8A it is seen that the phase front will impinge upon all of the antenna elements 104A to 104*n* at the same time and a receiver beam will be formed perpendicular to the array along an antenna axis, or boresite, B (for simplicity, time delay, amplifier and beamformer circuits are not illustrated). In such instance the delays provided by all of the time delay units connected to the respective antenna elements are equal.

If various delays are applied to the antenna element signals a beam may be processed which is pointed in another direction. For example, in FIG. 8B a uniphase front 116 is illustrated as initially exciting end antenna element 104*n* while it is still at a distance $\delta$ from end element 104A. By applying a time delay to the signal from antenna element 104*n* equivalent to the time for the phase front 116 to reach antenna element 104A, and applying respective smaller delays to the signals from the intermediate antenna elements, a beam may be formed which points at an off-axis angle $\theta$ along line B' relative to boresite B. Depending upon the angle $\theta$, $\delta$ may be many wavelengths.

Figure 8B:
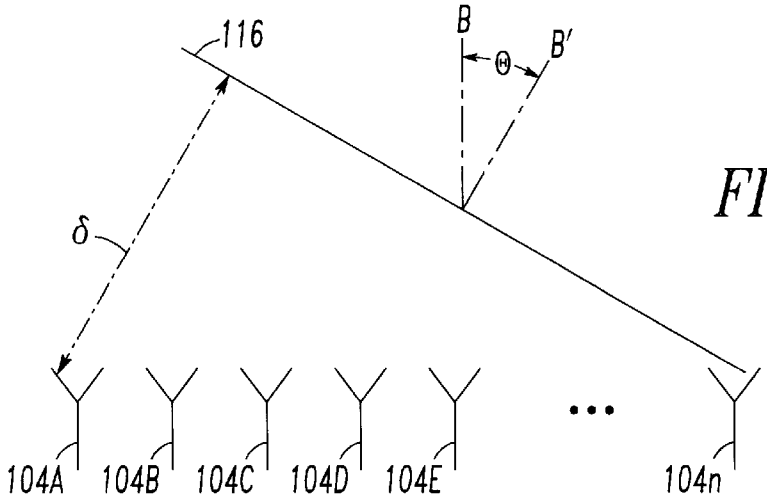

The principles applicable to the receive case of FIGS. 8A and 8B are equally applicable to the transmit mode of operation by delaying the microwave signals which are applied to the antenna elements. In addition, by providing multiple time delays for each antenna element, or groups of elements, multiple simultaneous beams may be formed.

Figure 9:
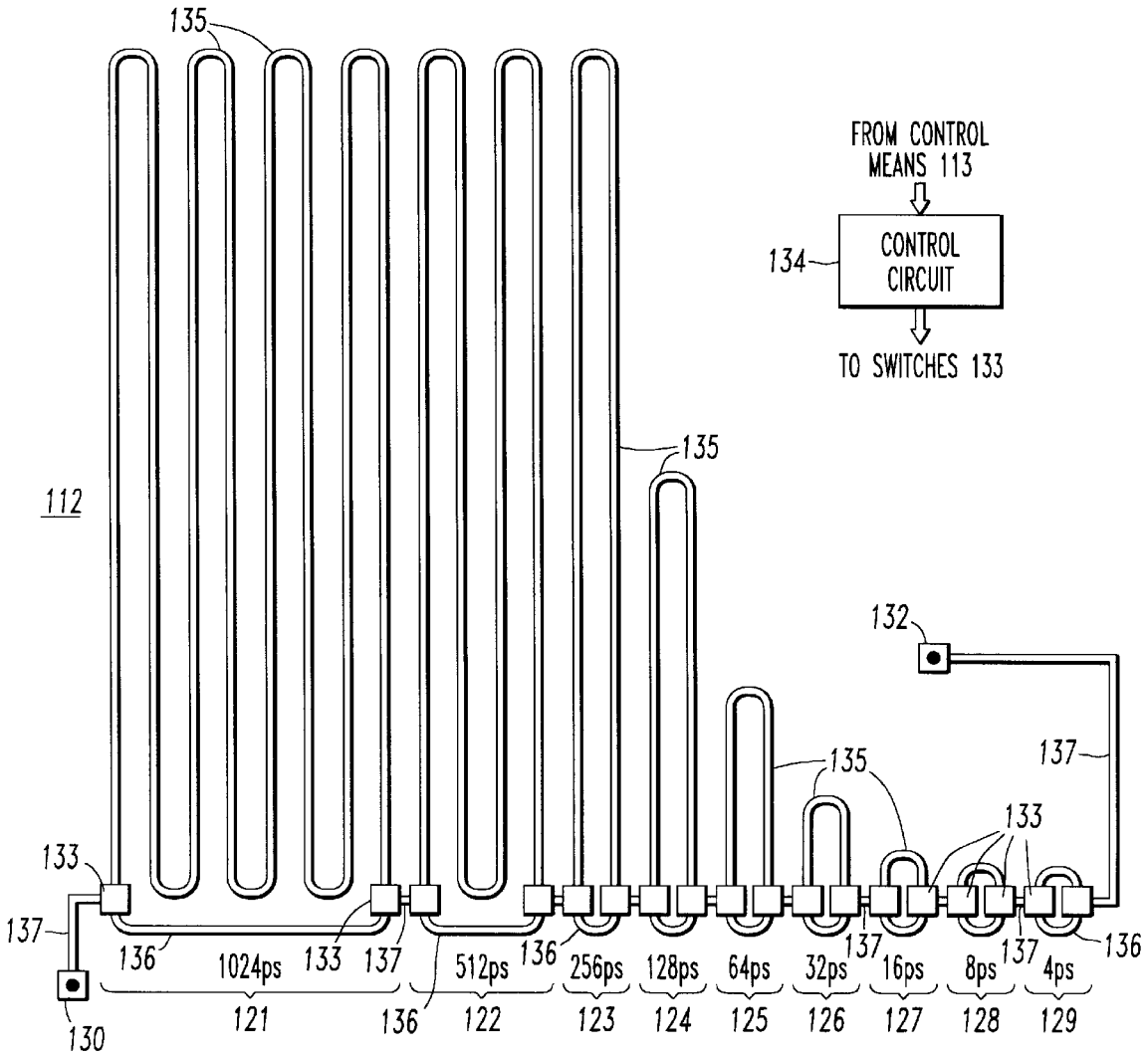
FIG. 9 illustrates a time delay circuit of FIG. 8 in more detail.

A typical time delay unit 112 is illustrated in more detail in FIG. 9. The time delay unit 112 includes nine stages of delay, 121–129 which, when selectively placed into the signal path, can control the relative time delay of a signal applied to input terminal 130, from 0 ns to 2.044 ns in 4 ps increments, until the signal appears at output terminal 132.

From FIG. 9 it is seen that stage 121 is capable of a 1024 ps delay, with delays of 512 ps, 256 ps, 128 ps, 64 ps, 32 ps, 16 ps, 8 ps, and 4 ps being provided by respective stages 122–129. The selection of the particular stages to be in the signal path is governed by inclusion of single pole, double throw mercury wetted switch arrangements utilizing the principles described herein, and identified by reference characters 133 in FIG. 9, the on and off conditions of which are governed by signals provided by control circuit 134, in response to command signals from control means 113 (FIG. 8).

Each of the delay line stages 121–129 includes a delay segment 135, a bypass segment 136 and an interstage connector 137.

Figure 10:
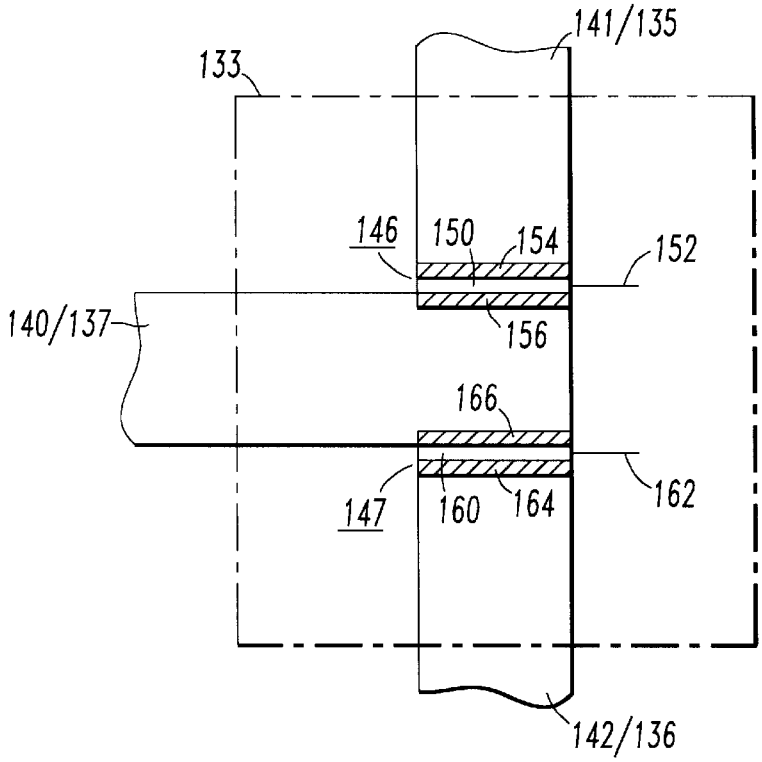
FIG. 10 illustrates, in more detail, a switch arrangement used in the time delay circuit of FIG. 9.

A typical switch arrangement 133 is illustrated in more detail in FIG. 10. The arrangement includes three microstrip conductors one of which, 140 is electrically connectable with an interstage connector 137, another of which, 141, is electrically connectable with a delay segment 135 and another of which, 142, is electrically connectable with bypass segment 136. In the embodiment of FIG. 10 conductors 140, 141 and 142 are integral with respective lines 137, 135 and 136.

Routing of the signal on interstage connector 140 to either conductor 141 or 142 is accomplished by the provision of respective mercury switches 146 and 147, each having a construction as previously described.

That is, switch 146 includes a gate member 150 having a gate electrode 152 to which is applied a control signal for governing movement of mercury droplets 154 and 156 for closing switch 146, whereby conductor 141 and the particular delay segment is selected for the signal path.

In a similar fashion, switch 147 includes a gate member 160 having a gate electrode 162 to which is applied a control signal for governing movement of the mercury droplets 164 and 166 for closing switch 147, whereby conductor 142 and the particular bypass segment is selected for the signal path.

Figure 10A:
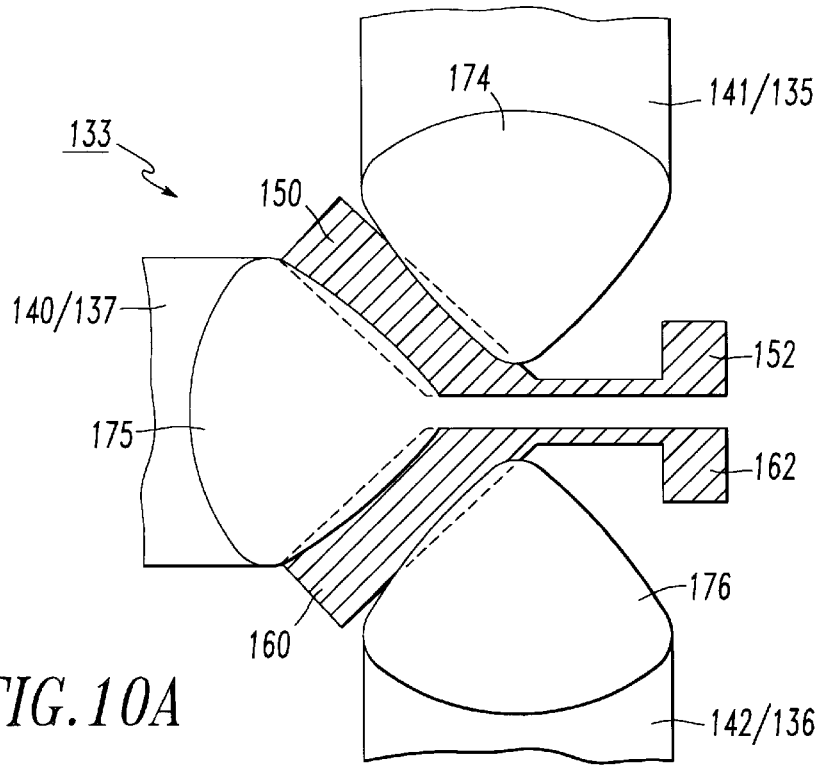
FIG. 10A illustrates another switch arrangement which may be used in the time delay circuit of FIG. 9.

FIG. 10A illustrates another switch arrangement 133 which accomplishes the same function as that shown in FIG. 10, however with one less mercury droplet. More particularly, the switch arrangement of FIG. 10A includes mercury droplets 174, 175 and 176, with droplets 174 and 175 having common gate member 150, and with droplets 175 and 176 having common gate member 160. Application of a control signal to gate electrode 152 will select the delay segment path 141/135 while a control signal applied to gate electrode 162 will select the bypass path 142/136.

An important aspect of the antenna system of the present invention is a means to assure that individual time delay and bypass lines do not couple to adjacent lines so as to degrade the accurate time delay provided by time delay unit 112 (FIG. 9). To this end reference is made to FIG. 11 which illustrates a time delay unit 112 enclosed in a package 178 along with control circuit 134. Owing to the small sized switches utilized and the time delay unit design, the components may be contained in a package which is less than $\lambda \times \lambda$ where $\lambda$ is the wavelength of the highest frequency of interest. For the embodiment of FIG. 11, with an upper frequency of 10 GHz, the package may be around $0.6\lambda \times 0.6\lambda$, where $\lambda$ is the wavelength of the highest frequency of interest.

Figure 12:
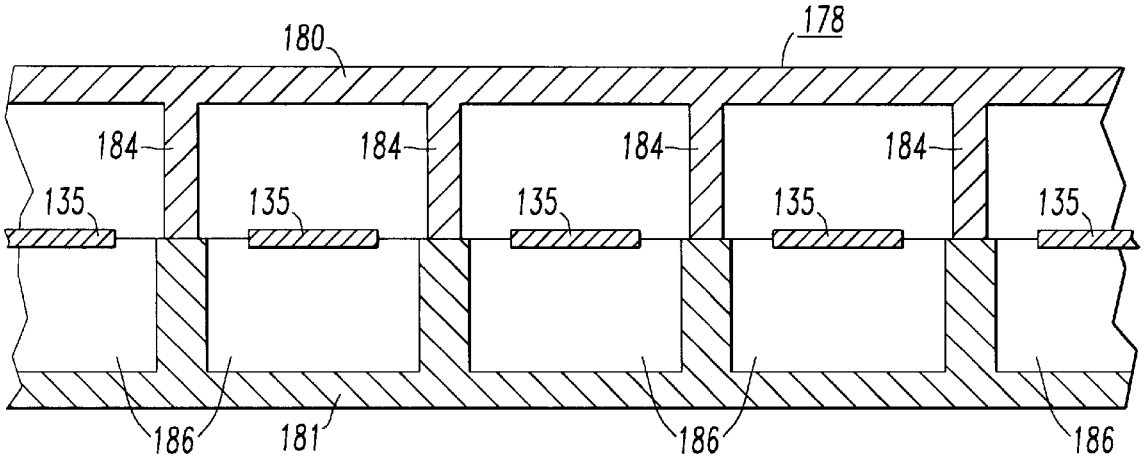
FIG. 12 is a partial cross-sectional view of the delay unit, along line 12—12 of FIG. 11.
Figure 11:
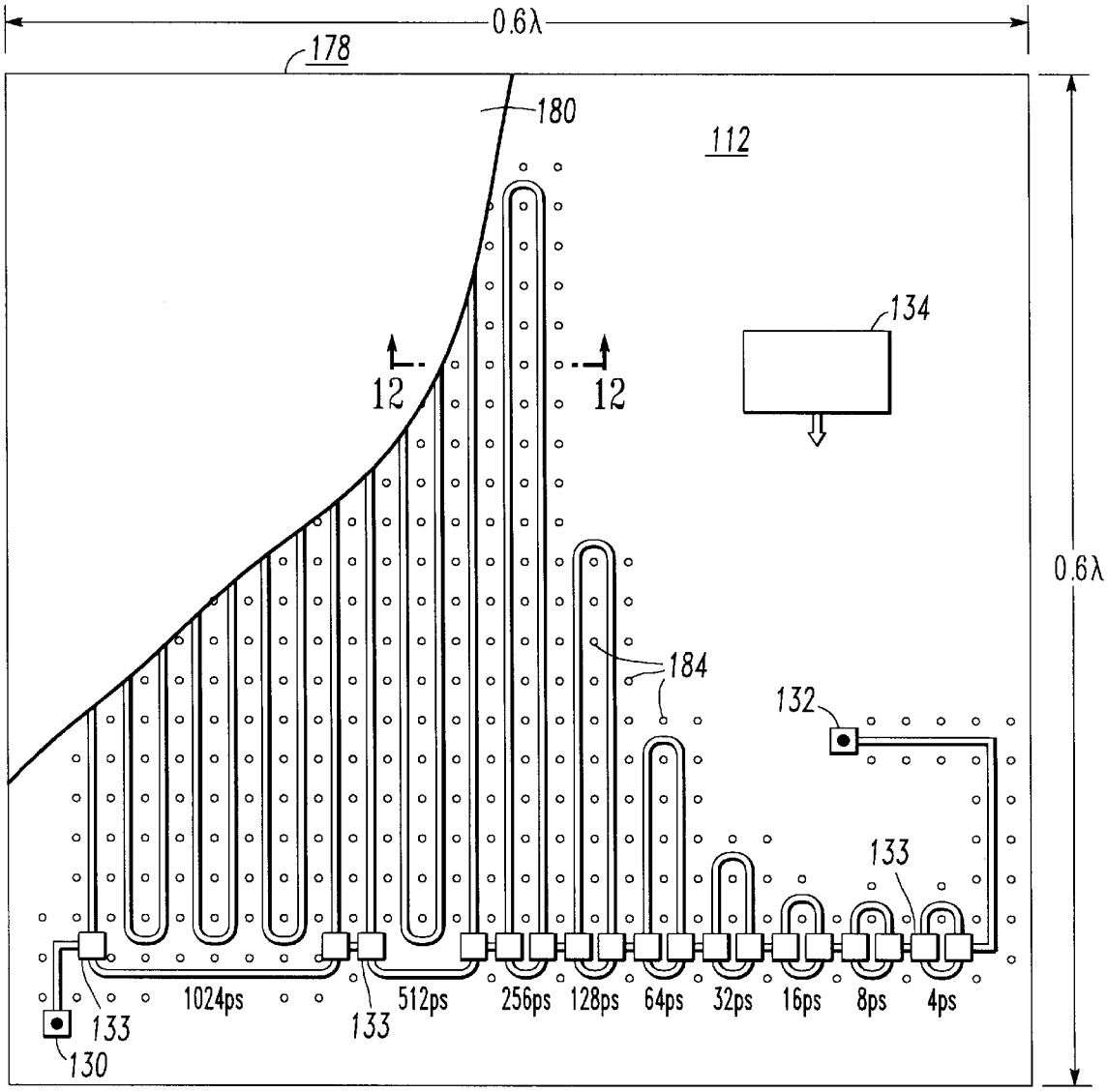
FIG. 11 illustrates a packaged time delay unit.

With additional reference to FIG. 12, which is a partial cross-section along line 12—12 of FIG. 11, it is see n that package 178 includes respective electrically grounding top and bottom cover members 180 and 181 electrically connected together by means of electrically conductive vias, or posts, 184 spaced apart preferably less than every $\frac{1}{10}\lambda$.

Adjacent lines of the delay segment 135 are illustrated as being encased in a dielectric medium such as alumina 186 such that each microstrip line is enclosed in its own shielded cage, thus permitting long closely packed time delay lines without cross couplin g effects that can lead to multiple reflections and noise.

The package 178 can be fabricated in two halves, a top half and a bottom half and then joined together. In order to accommodate for slight misalignments of the top and bottom vias 184, one of the vias made be of a larger diameter than the other, as illustrated in FIG. 12 wherein the bottom portion of the via 184 is larger than the top portion.

Figure 13A:
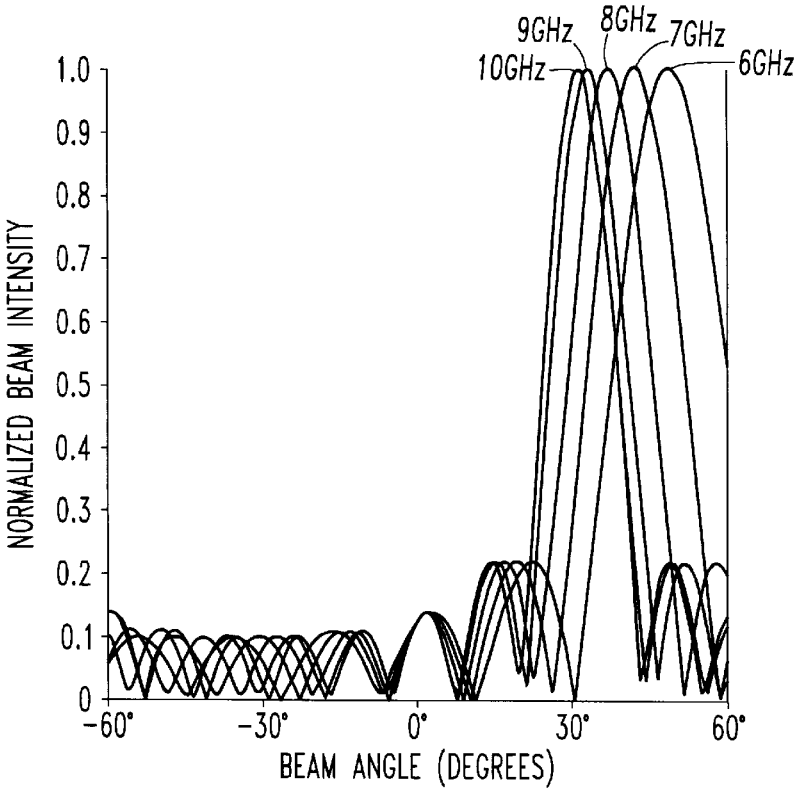
FIG. 13A PRIOR ART
FIGS. 13A and 13B respectively illustrate beam patterns obtained utilizing phase shifters and with time delay circuits.
Figure 13B:
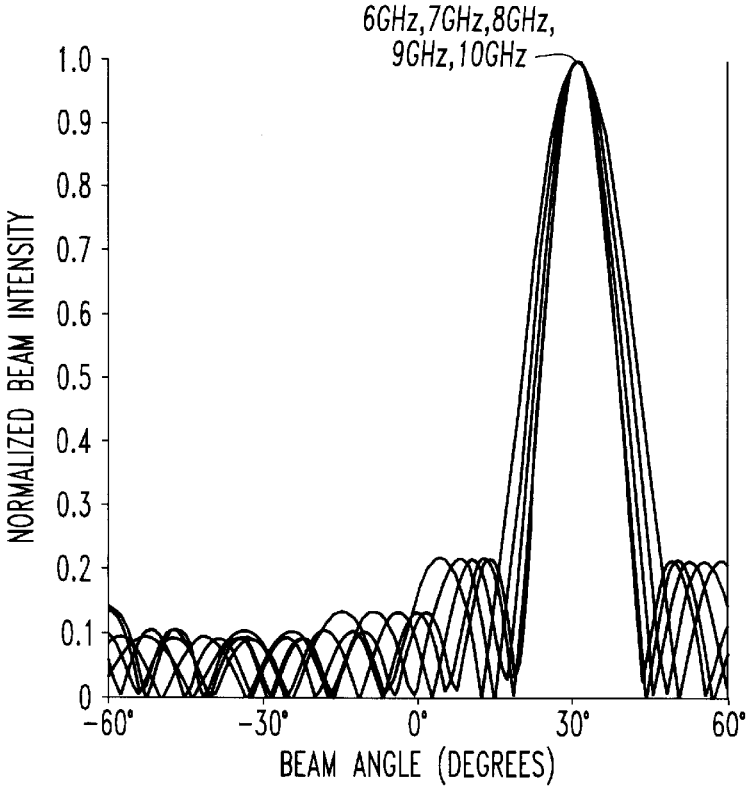

FIGS. 13A and 13B are idealized computer generated beam patterns illustrating the advantages of using time delay circuits in lieu of phase shifters. As was stated, phase shifters are good for single frequency use and do not perform well for wideband operation. To demonstrate this, reference is made to FIG. 13A, wherein beam angle, in degrees, is plotted on the horizontal axis and normalized beam intensity is plotted on the vertical axis.

In FIG. 13A, utilizing typical phase shifters; a beam is steered to a nominal beam angle of 30°. The beam responses for operating frequencies of 6, 7, 8, 9, and 10 GHz are illustrated. It is seen that with the phase shifters there is an objectionable change in beam position with change in frequency.

In contrast, and as illustrated in FIG. 13B, with time delay units in place of phase shifters, there is excellent preservation of beam shape, all centered about the 30° scan angle, across the same frequency range 6 to 10 GHz, as depicted in FIG. 13A.

The time delay units with the present invention, utilizing the mercury wetted switches described herein, offer true time delay and superior operating characteristics than comparable pin or GaAs switches typically used in time delay units.

Figure 14A:
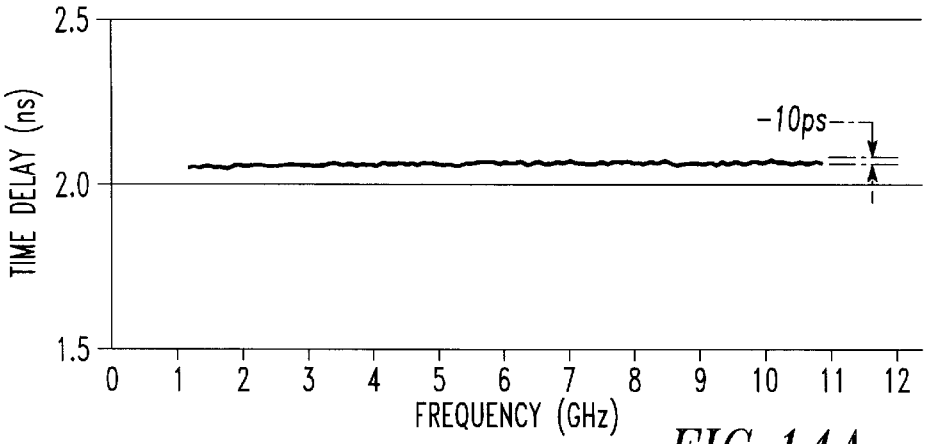
FIGS. 14A, 14B and 14C are frequency response curves of various switches utilizable in the time delay unit of FIG. 9.
Figure 14B:
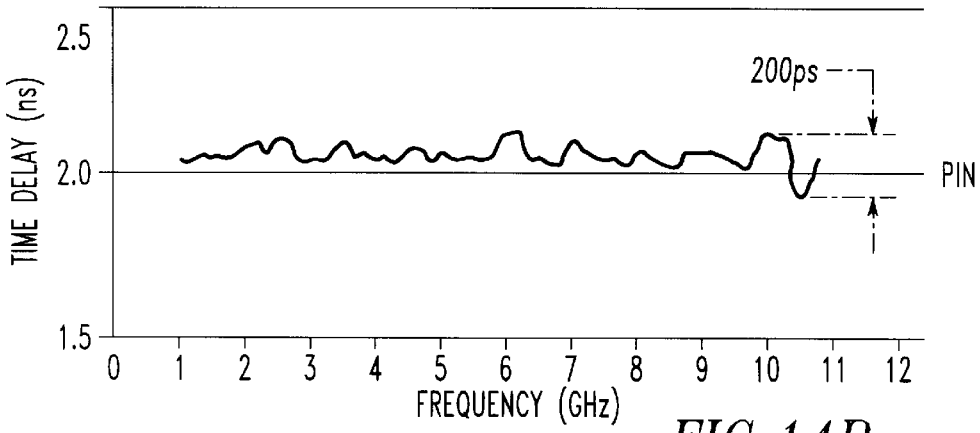
FIG. 14B PRIOR ART
Figure 14C:
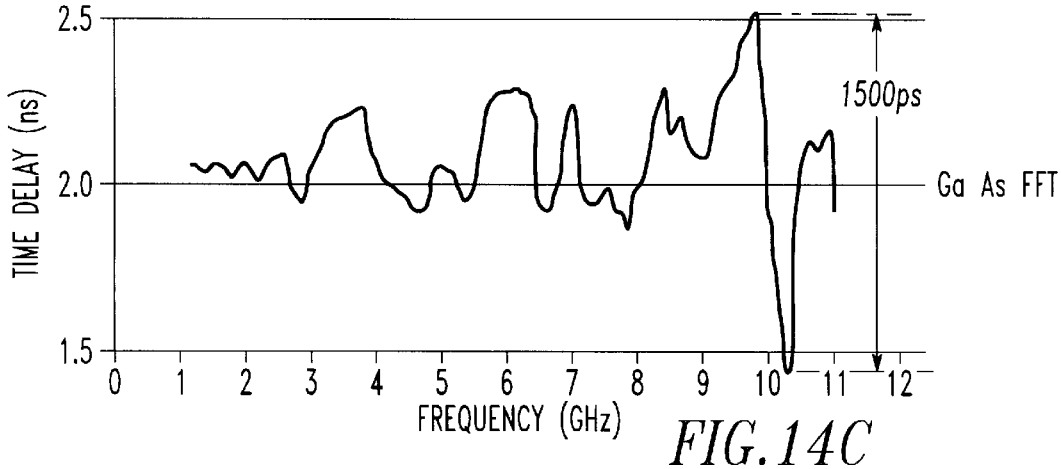
FIG. 14C PRIOR ART

For example, FIGS. 14A, 14B and 14C illustrate a computer generated broadband response of three types of switches used in the time delay unit of FIG. 9. In the simulation all 18 switches are activated to route an input microwave signal through all of the delay segments, for a maximum delay of 2.044 ns.

FIG. 14A illustrates the response of the mercury wetted switch described herein, in FIG. 10. As seen in FIG. 14A, the extremely low $C_{off}$ and $R_{on}$ of the mercury wetted switch results in a response with very low ripple, less than approximately 2 ps, over a very broadband approaching 1 to 11 GHz. Essentially, the time delay remains true over this band of operation, resulting in a precise beam integrity required for advanced broadband systems.

FIG. 14B illustrates the response for a pin diode switch and FIG. 14C illustrates the response for a GaAs switch. It may be seen that these switches, under the same measurement conditions as in FIG. 14A, generate ripple (approximately 200 ps and 1500 ps respectively) which is much too large, and would result in a degradation of beam integrity.

Although the present invention has been described with a certain degree of particularity, it is to be understood that various substitutions and modifications may be made, including those illustrated in the aforementioned application, without departing from the spirit and scope of the invention as defined in the appended claims.

What is claimed is:

1. An electronically steerable antenna array system, comprising:

(A) a plurality of antenna elements;

(B) a plurality of time delay units connected in signal transfer relationship with a selected one of said antenna elements;

(C) each said time delay unit including a signal input and signal output and a plurality of microstrip delay line stages each stage having a delay line segment and bypass segment selectively insertable in circuit between said input and said output;

(D) said delay line stages being electrically connected in series by respective interstage connectors;

(E) a plurality of mercury wetted switches connected to said delay line stages and operable upon application of predetermined control signals to selectively insert predetermined ones of said delay line segments into said circuit;

(F) each said mercury wetted switch including three microstrip conductors, one of said conductors being electrically connectable with a said delay line segment, another of said conductors being electrically connectable with a said bypass segment and another of said conductors being electrically connectable with a said interstage connector;

(G) each said conductor including a mercury droplet which forms electrical contact with a mercury droplet of one of said other conductors upon the application of said predetermined control signals.

2. A system according to claim 1 wherein:

(A) respective ones of said microstrip conductors of said mercury wetted switch are respectively integral with said delay line segment, said bypass segment and said interstage connector.

3. A system according to claim 1 wherein:

(A) said delay line stages are of progressively smaller delay times.

4. A system according to claim 3 wherein:

(A) said time delay unit including at least nine said delay line stages providing a delay from a minimum delay to a maximum delay of 2.044 ns, in 4 ps increments.

5. A system according to claim 1 wherein:

(A) each said mercury wetted switch includes four mercury droplets for connecting an interstage connector with a selected one of said delay line segment and bypass segment.

6. A system according to claim 1 wherein:

(A) each said mercury wetted switch includes three mercury droplets for connecting an interstage connector with a selected one of said delay line segment or bypass segment.

7. A system according to claim 1 wherein:

(A) each said mercury wetted switch has an on resistance Ron which is on the order of 20 milliohms.

8. A system according to claim 1 wherein:

(A) each said mercury wetted switch has an off capacitance $C_{off}$ which is on the order of $2.5\times10^{-14}$ farads.

9. A system according to claim 1 wherein:

(A) each said time delay unit is encased in a package having electrically conducting and electrically joined top and bottom cover members.

10. A system according to claim 9 wherein:

(A) said top and bottom cover members are electrically joined by a plurality of electrically conducting posts positioned adjacent said delay line segments, bypass segments and interstage connectors.

11. A system according to claim 10 wherein:

(A) said posts are spaced at a distance of at less than $\frac{1}{10}\lambda$ from one another, where $\lambda$ is the wavelength of the highest frequency of interest.

12. A system according to claim 9 wherein:

(A) said package has a measurement of less than $\lambda$, where $\lambda$ is the wavelength of the highest frequency of interest.

13. A system according to claim 12 wherein:

(A) said package is rectangular and has a measurement of around $0.6\lambda\times0.6\lambda$.

* * * * *